US007305783B2

(12) United States Patent
Mix et al.

(10) Patent No.: US 7,305,783 B2
(45) **Date of Patent: *Dec. 11, 2007**

(54) LENTICULAR FIREPLACE

(75) Inventors: Devin Eugene Mix, Lakeville, MN (US); David Charles Lyons, Red Wing, MN (US)

(73) Assignee: HNI Technologies Inc., Muscatine, IA (US)

( * ) Notice: Subject to any disclaimer, the term of this patent is extended or adjusted under 35 U.S.C. 154(b) by 0 days.

This patent is subject to a terminal disclaimer.

(21) Appl. No.: 11/075,933

(22) Filed: Mar. 9, 2005

(65) Prior Publication Data

US 2005/0155262 A1 Jul. 21, 2005

Related U.S. Application Data

(63) Continuation of application No. 09/859,719, filed on May 16, 2001, now Pat. No. 6,880,275.

(51) Int. Cl.
*G09F 19/00* (2006.01)

(52) U.S. Cl. ..... 40/428

(58) Field of Classification Search ..... 40/428, 40/427, 431, 454, 436; 392/348; 362/806, 362/812; 472/65

See application file for complete search history.

(56) References Cited

U.S. PATENT DOCUMENTS

| | | | | |
|---|---|---|---|---|
| 747,045 | A | 12/1903 | Carter | |
| 2,371,172 | A * | 3/1945 | Hotchner | 40/436 |
| 2,507,975 | A * | 5/1950 | Hotchner | 40/436 |
| 2,708,114 | A | 5/1955 | Hancock | |
| 3,395,475 | A | 8/1968 | Moss | |
| 3,445,948 | A | 5/1969 | Moss et al. | |
| 3,603,013 | A | 9/1971 | Reed et al. | |
| 3,699,697 | A | 10/1972 | Painton | |
| 3,726,025 | A | 4/1973 | Salem | |
| 3,742,189 | A | 6/1973 | Conroy et al. | |
| 3,978,598 | A * | 9/1976 | Rose et al. | 40/428 |
| 4,693,694 | A | 9/1987 | Seki | |
| 4,890,600 | A | 1/1990 | Meyers | |
| 4,965,707 | A | 10/1990 | Butterfield | |
| 5,146,703 | A * | 9/1992 | Boden | 40/454 |
| 5,195,820 | A | 3/1993 | Rehberg | |
| 5,359,454 | A | 10/1994 | Steenblik | |
| 5,613,487 | A | 3/1997 | Hawkinson | |
| 5,642,580 | A | 7/1997 | Hess et al. | |

(Continued)

FOREIGN PATENT DOCUMENTS

GB 2 210 969 A 6/1989

(Continued)

*Primary Examiner*—S. Joseph Morano
*Assistant Examiner*—Robert J. McCarry, Jr.
(74) *Attorney, Agent, or Firm*—Faegre & Benson LLP

(57) ABSTRACT

A lenticular fireplace and methods for simulating a fire within a fireplace. In one respect, a fire is simulated with a lenticular screen. The lenticular screen includes a lenticular lens layer and an image layer, wherein the image layer comprises one or more images of a fire. A device is coupled to the lenticular screen that moves the lenticular screen to alter a viewed image of the fire. In another respect, the lenticular screen is disposed within a fireplace enclosure. In another respect, a fireplace includes a convertible heated glass apparatus. The apparatus is used in a front wall of an enclosure.

17 Claims, 11 Drawing Sheets

U.S. PATENT DOCUMENTS

| | | | | |
|---|---|---|---|---|
| 5,995,685 | A | 11/1999 | Seino | |
| 6,047,489 | A | 4/2000 | Hess et al. | |
| 6,050,011 | A | 4/2000 | Hess et al. | |
| 6,053,165 | A | 4/2000 | Butler et al. | |
| 6,078,424 | A | 6/2000 | Morton | |
| 6,094,291 | A | 7/2000 | Kashyap | |
| 6,162,047 | A | 12/2000 | Hess | |
| 6,190,019 | B1 | 2/2001 | Hess | |
| 6,224,223 | B1 | 5/2001 | Higuchi | |
| 6,237,264 | B1 | 5/2001 | Gulick | |
| 6,259,550 | B1 | 7/2001 | Gottfried et al. | |
| 6,269,567 | B1 | 8/2001 | MacPherson et al. | |
| 6,302,555 | B1 | 10/2001 | Bristow | |
| 6,363,636 | B1 | 4/2002 | Hess et al. | |
| 6,393,207 | B1 | 5/2002 | Martin et al. | |
| 6,564,485 | B1 * | 5/2003 | Hess | 40/428 |
| 2002/0166554 | A1 | 11/2002 | Berg | |

FOREIGN PATENT DOCUMENTS

| | | | |
|---|---|---|---|
| GB | 2 350 420 | A | 11/2000 |
| JP | 0211437 | A | 8/1990 |
| JP | 2211437 | * | 8/1990 |
| JP | 11142995 | A * | 5/1999 |

* cited by examiner

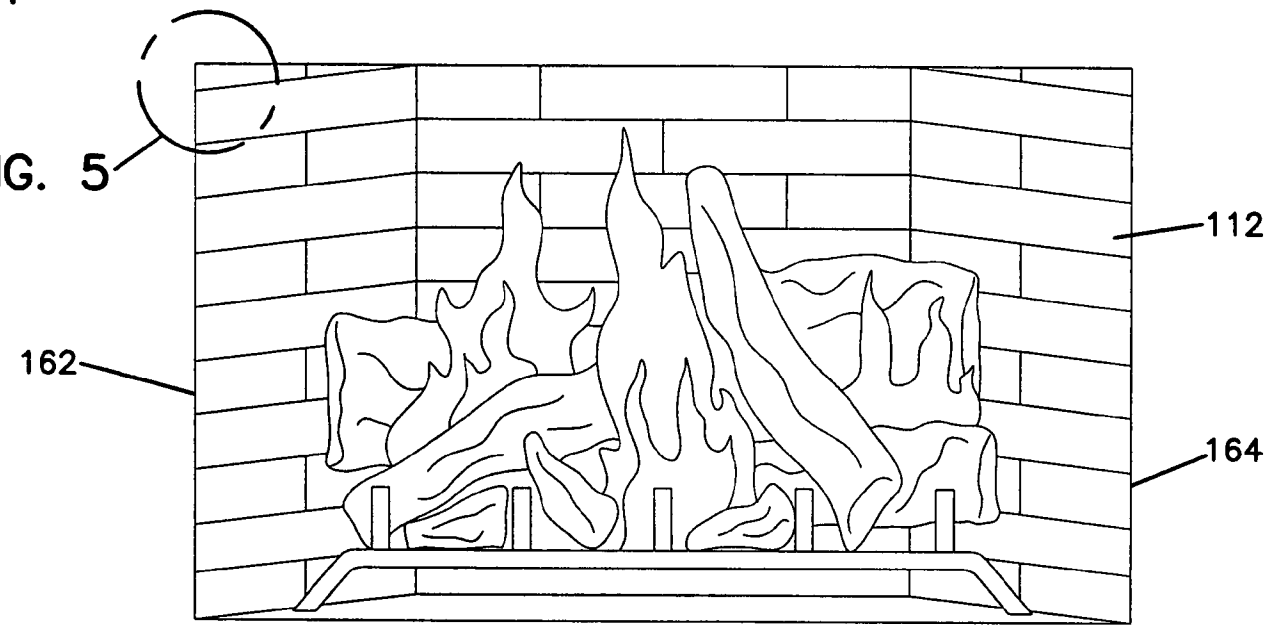
FIG. 4
FIG. 5
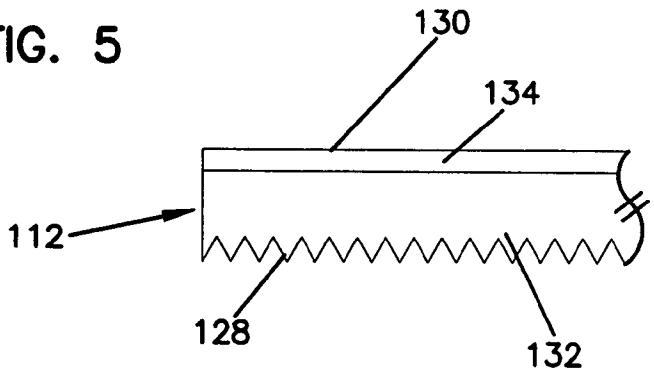
FIG. 5

200
206
208
212
216
218
219
220
221
222

LENTICULAR FIREPLACE

CROSS-REFERENCE TO RELATED APPLICATIONS

This application is a continuation of application Ser. No. 09/859,719, filed May 16, 2001 now U.S. Pat. No. 6,880, 275, which application is incorporated herein by reference.

FIELD OF THE INVENTION

The present invention relates to fireplaces. More particularly, the fireplace includes a lenticular screen to simulate a fire within a firebox. The present invention also relates to a device for moving the lenticular screen, a convertible heated glass apparatus for a fireplace, and a flame simulation apparatus to generate artificial flames.

BACKGROUND OF THE INVENTION

Fireplaces are an efficient method for providing warmth and creating the appeal of a fire within a room. Fireplaces have become commonplace in today's building trades for both residential and commercial applications. Most new home construction designs include at least one, and often several fireplaces. Further, a significant number of remodeling projects are focused on fireplaces.

Gas, electric, and wood burning fireplace units require a significant amount of wall and/or floor space for their operation. Also, when simulating a fire in a firebox it is often difficult to produce a natural looking flame or burning log effect. An additional problem is that when a fireplace is not in operation the viewer can see the hardware contained within a fireplace enclosure. For example, fireplaces using gas burner systems or electrically simulated fires include viewable structural elements and hardware that decreases the overall viewing pleasure and diminish the aesthetic quality of the fireplace.

SUMMARY OF THE INVENTION

Generally, the present invention relates to fireplaces. The fireplace can include a lenticular screen, a device for moving the lenticular screen, a convertible heated glass element that becomes less opaque upon heating, and a bobble-flame apparatus to simulate the flames of a fire on the lenticular screen.

In one respect, the invention relates to a fireplace for simulating a natural fire. The fireplace includes a front panel and a lenticular screen viewable through the front panel. The lenticular screen includes a lenticular lens layer and an image layer disposed on the lenticular lens layer to simulate a fire.

In another respect, the invention relates to an apparatus for simulating a fireplace fire. The apparatus includes a lenticular screen. The lenticular screen includes a lenticular lens layer and an image layer. The image layer includes one or more images of a fire and is disposed on a back surface of lenticular screen. A device is coupled to the lenticular screen that moves the lenticular screen to alter a viewed image of the fire.

In another respect, the invention relates to a fireplace for simulating a natural fire. The fireplace includes an enclosure defining a chamber. A lenticular screen is disposed within the chamber, wherein the lenticular screen comprises a lenticular lens layer and an image layer disposed on the lenticular lens layer to simulate a fire.

In another respect, the invention relates to a fireplace. The fireplace includes an enclosure having a front wall. The front wall includes an electrically conductive panel coupled to a phase change material. Electrical terminals are operatively connected to the electrically conductive panel for applying a voltage across the electrically conductive panel to heat the front wall and convert the phase change material from an opaque solid to a less opaque liquid to allow viewing through the front wall. A lenticular screen includes a front surface and a back surface.

In another respect, the invention relates to a flame simulation apparatus for a fireplace. The flame simulation apparatus includes a translucent screen having a front surface and a back surface, at least one bobble-flame coupled to a support panel, a device to move the bobble-flame, and a light source to reflect light off of the bobble-flame and onto the back surface of a translucent screen to generate an image of a flickering flame effect that is viewable from the front surface of the translucent screen.

In another respect, the invention relates to a flame simulation apparatus for a fireplace. The flame simulation apparatus includes a translucent screen having a front surface and a back surface, a plurality of bobble-flames coupled to a support panel, a device to move the bobble-flames, and a light source to reflect light off of the bobble-flames and onto the back surface of a translucent screen to generate an image of a flickering flame effect that is viewable from the front surface of the translucent screen.

In another respect, the invention relates to a fireplace for simulating a natural fire. The fireplace includes a front wall. The front wall includes an electrically conductive panel coupled to a phase change material. Electrical terminals are operatively connected to the electrically conductive panel for applying a voltage across the electrically conductive panel to heat the front wall and convert the phase change material from an opaque solid to a less opaque liquid to allow viewing through the front wall. A lenticular screen includes a front surface and a back surface. The lenticular screen is viewable through the front wall when the phase change material is the less opaque liquid. The lenticular screen includes a lenticular lens layer and a fire image layer disposed on the lenticular lens layer. At least one bobble-flame is coupled to a support panel. A device moves the bobble-flame. A light source reflects light off of the bobble-flame and onto the back surface of the lenticular screen to generate an image of a flickering flame effect that is viewable from the front surface of the lenticular screen.

In another respect, the invention relates to a method for simulating a fire within an enclosure, comprising the steps of: disposing a lenticular screen within the enclosure, wherein the lenticular screen comprises a lenticular lens layer and a fire image layer; and moving the lenticular screen to change an image of the fire viewed from the fire image layer.

In another respect, the invention relates to a method for simulating flames of a fire, comprising the steps of: coupling a bobble-flame to a support panel; moving the bobble-flame; and reflecting light off of the bobble-flame and onto a back surface of a translucent screen to generate an image of a flickering flame.

In another respect, the invention relates to a method for selectively revealing items disposed within a fireplace enclosure comprising the steps of: providing a front wall of the fireplace enclosure, wherein the front wall comprises an electrically conductive panel coupled to a phase change material; and providing a voltage source coupled to the electrically conductive layer to heat the front wall and convert the phase change material from an opaque solid to a less opaque liquid to allow selective viewing through the front wall.

The above summary of the present invention is not intended to describe each disclosed embodiment or every implementation of the present invention. The Figures and the detailed description that follow more particularly exemplify embodiments of the invention. While certain embodiment of the invention will be illustrated in describing embodiments of the invention, the invention is not limited to use in such embodiments.

BRIEF DESCRIPTION OF THE DRAWINGS

The invention may be more completely understood in consideration of the following detailed description of various embodiments of the invention in connection with the accompanying drawings, in which:

FIG. 4 is a schematic front view of one embodiment of a lenticular screen;

FIG. 5 is a schematic detailed top view of a portion of the lenticular screen of FIG. 4;

Figure 1:
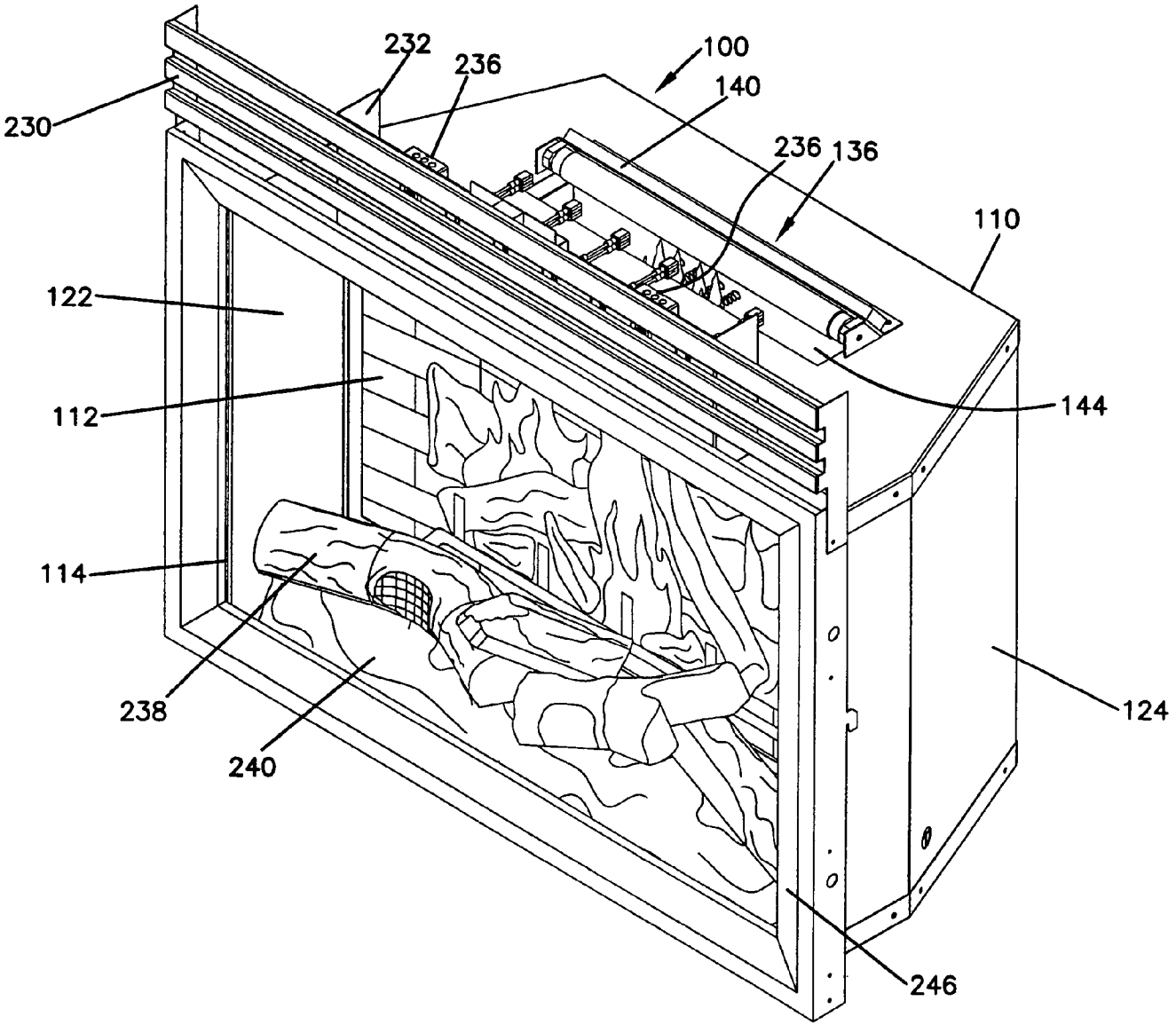
FIG. 1 is a schematic perspective view of one embodiment of a lenticular fireplace.

While the invention is amenable to various modifications and alternative forms, specifics thereof have been shown by way of example in the drawings and will be described in detail. It should be understood, however, that the intention is not to limit the invention to the particular embodiments described. On the contrary, the intention is to cover all modifications, equivalents, and alternatives falling within the spirit and scope of the invention.

DETAILED DESCRIPTION OF THE PREFERRED EMBODIMENTS

The invention is applicable to fireplaces. In particular, the invention is directed to a lenticular fireplace. In some embodiments, the lenticular fireplace includes a lenticular screen having a simulated fire image. In another embodiment, the fireplace includes a heated glass system that changes a front wall of a fireplace from opaque to less opaque upon heating. In another embodiment, the fireplace includes a flame simulation apparatus. In yet another embodiment, the fireplace includes the lenticular lens used with the heated glass apparatus and the flame simulation apparatus.

While the present invention is not so limited, an appreciation of various aspects of the invention will be gained through a discussion of the examples provided below.

Lenticular Lens

The general structure of the lenticular fireplace includes a lenticular screen disposed within an enclosure. Such a fireplace can have one or more advantages over current simulated fireplace systems. For example, the lenticular lens construction can offer a simple, realistic, easy to install, three dimensional, and cost effective fireplace that saves space within a home, apartment or other structure. The lenticular simulation of a firebox, log set, and fire eliminates the need for the physical presence of these and other items such as a burner system and ductwork for exhaustion of combustion gases.

Figure 2:
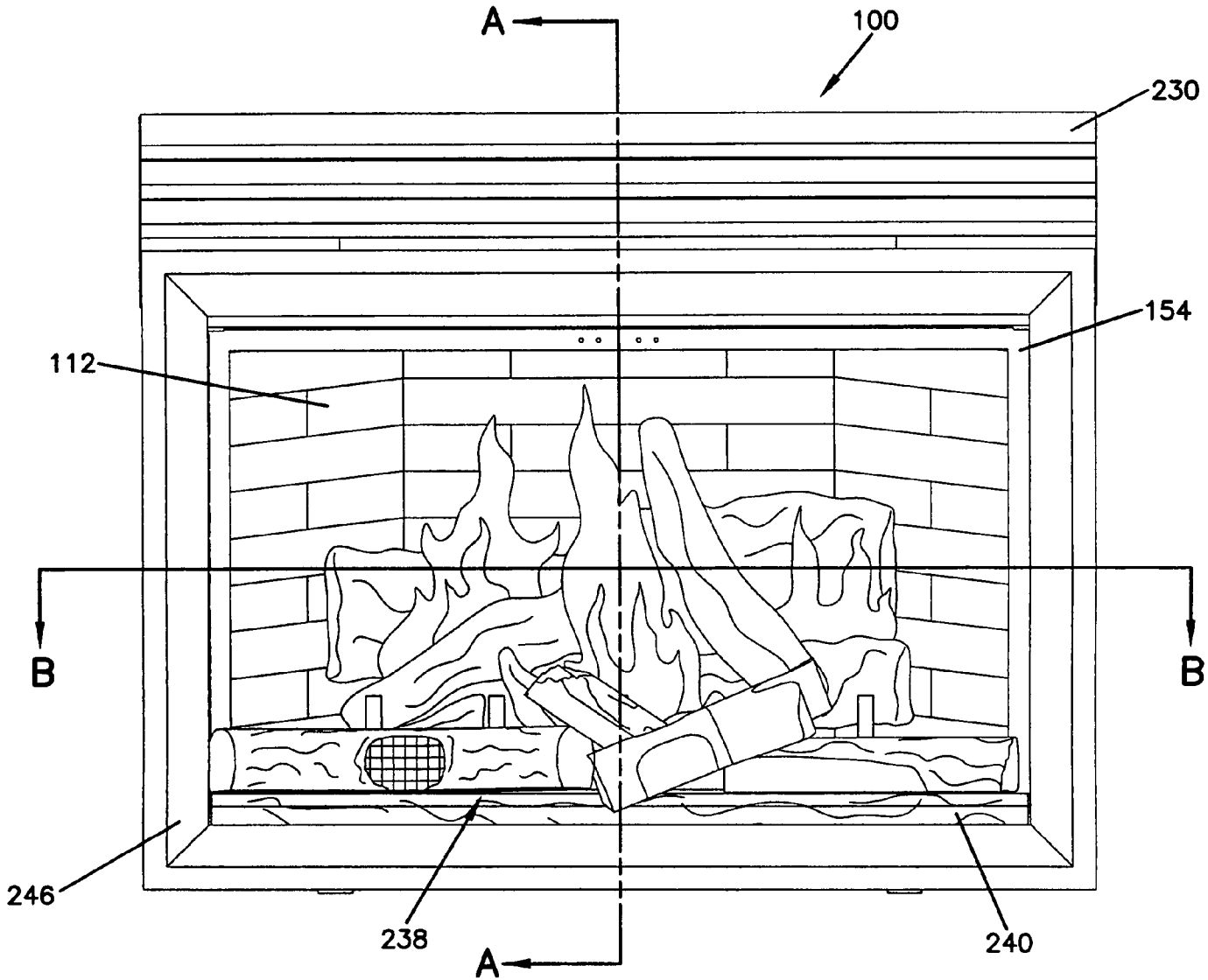
FIG. 2 is a schematic front view of the lenticular fireplace of FIG. 1.

Referring to FIGS. 1 and 2, perspective and front schematic views of one embodiment of a lenticular fireplace 100 is shown. The lenticular fireplace 100 includes a fireplace enclosure 110 that houses a lenticular screen 112. The lenticular screen 112 provides a three dimensional image that simulates a fire against a brick background of a fireplace enclosure. The image shown on FIGS. 1-6 is only a representative image and other simulated fire images can be used.

Figure 3:
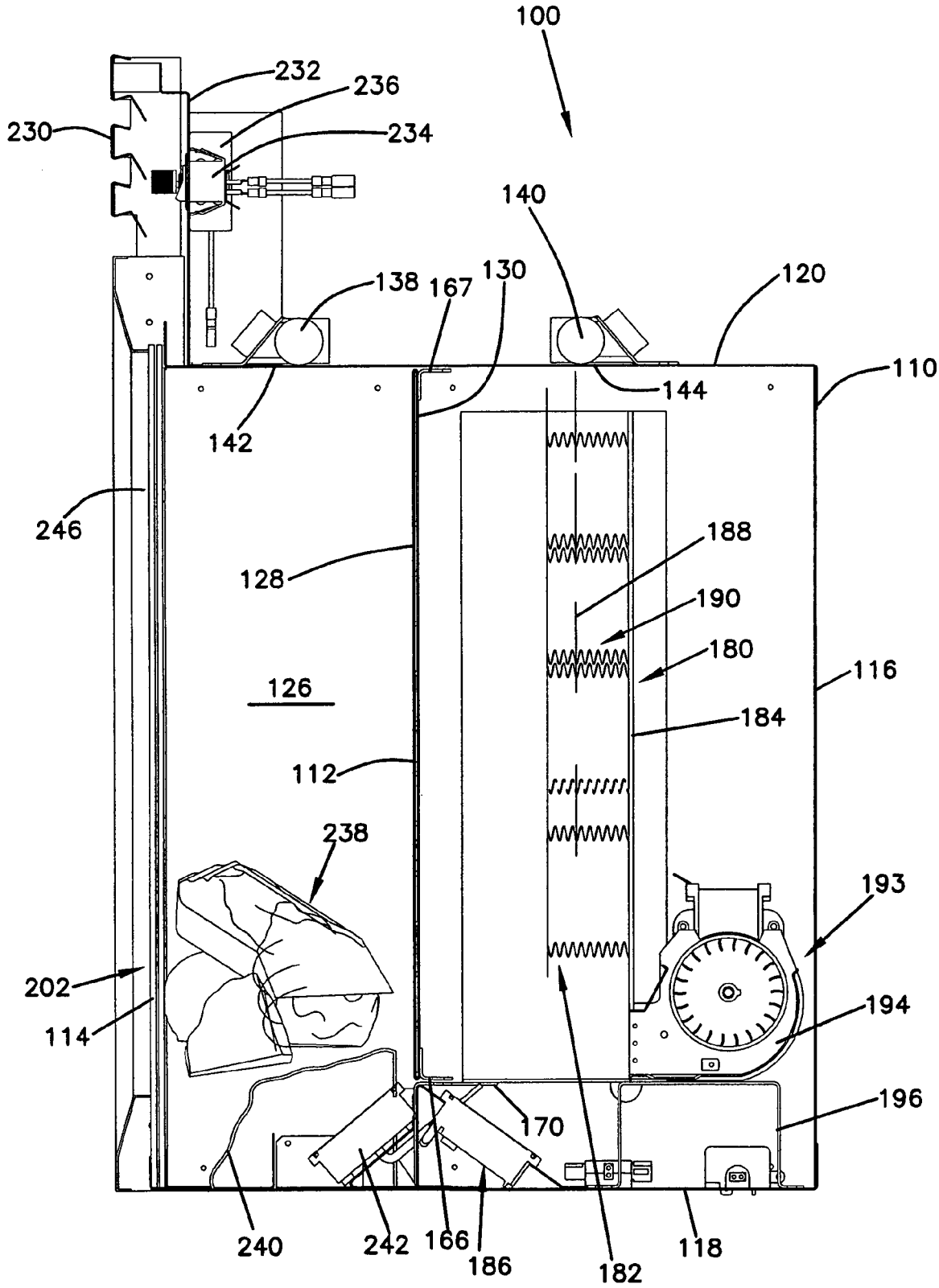
FIG. 3 is a schematic side elevation cross-sectional view of the lenticular fireplace along line A-A of FIG. 1.

The enclosure 110 can include a front panel 114, a rear panel 116, a bottom panel 118, a top panel 120, and side panels 122 and 124, as shown in FIGS. 1 and 3. In other embodiments, the enclosure 110 can include none of or some of the panels coupled to the front panel 114 to form the enclosure 110. In some embodiments, the front panel 114 is the only panel used in the construction and the lenticular screen 112 is disposed in a position that is viewable through the front panel 114. An example of an enclosure that uses only the front panel to form an enclosure involves constructing a fireplace within a hole cut in a wall of a structure. The lenticular screen can be recessed within the hole in the wall and the front panel can be placed over the hole after disposing the lenticular screen within the wall.

As shown in FIG. 2, the front panel 114 can be, for example, a translucent material, such as glass, ceramic, or plastic, to allow viewing of the lenticular screen 112 therethrough. In other embodiments, the front panel 114 can be a thermally transformable front wall that converts from opaque to less opaque upon heating, as described and discussed below for the heated glass element shown in FIGS. 9-12.

Referring to FIG. 3, a schematic cross-sectional view is shown of the fireplace of FIG. 2 along line A-A. The fireplace enclosure 110 defines a chamber 126. The lenticular screen 112 is disposed within the chamber 126. The chamber can be any space that may or may not include structures or panels surrounding the lenticular screen.

Referring to FIG. 4, a front schematic view of lenticular screen 112 is shown. The image or pattern on the lenticular screen preferably displays a three-dimensional or perspective image, as illustrated in FIG. 4. FIG. 5 shows an expanded schematic top view of the lenticular screen 112. The lenticular screen 112 includes a front surface 128 and a back surface 130. Typically, the lenticular screen 112 is translucent or semi-transparent to allow light to pass through from the rear surface 130 of the lenticular screen 112.

A lenticular lens layer 132 is arranged with an image layer 134 to form the lenticular screen 112. The lenticular lens layer 132 forms the front surface 128 of the lenticular screen 112 and the image layer 134 forms the back surface 130 of the lenticular screen 112.

The lenticular lens layer 132 includes a plurality of lenticule lenses having lens surfaces that define a two-dimensional ribbed planar configuration forming the front surface 128. FIG. 5 shows the ribbed configuration on front surface 128. Alternatively, the shape of individual lenticular lenses on the front surface can be any other suitable shape such as, for example, rounded.

Each lenticule, as an individual lens, has a focal length that can equal the thickness of the lenticular image layer and magnifies a narrow strip of the image layer 134. Depending on an observer's angle of view of the lenticular screen 112, an individual lens shows a different strip of the image layer 134. The angle of view is dependent upon the position of the lenticular screen relative to the person viewing it, which can optionally be changed by moving the screen. Alternatively, the angle of viewing can be altered by an observer of the fireplace walking past a stationary lenticular screen. An image as it appears to the observer changes as the relative position between the observer and the lenticular screen, or angle of view, changes because different strips of the image layer are being magnified.

The image layer 134 can include single, multiple levels of individual images, or an interlaced combination of images that are printed onto the lenticular lens layer 132 to form a desired image. The image can be reproduced onto the back surface of the lenticular lens with any conventional printing technology. A lenticular screen, such as lenticular screen 112, can be obtained from Travel Tags/American Vinylith located in Inver Grove Heights, Minn. The image can include fire, flames, burning embers, logs, a firebox, or any other image to simulate a fireplace. One example of an image is shown in FIGS. 2 and 4. Typically, the image layer 134 is translucent or semi-transparent to allow light to pass through from the back surface 130 of the lenticular screen 112. Alternatively, the image layer includes a backing material that blocks light from passing from the back surface to the front surface of the lenticular screen.

Optionally, a light source 136 (FIG. 1) can be positioned within fireplace 100 to enhance the image of the simulated fire on the lenticular screen 112. For example, lights 138 and 140 can be positioned over openings 142 and 144 formed in the top panel 120 of the enclosure 110. Although the embodiment in FIG. 3 shows two fluorescent lights, it should be understood that one or more lights and that different types of lights, such as halogen lights, could be used. The light or lights can alternatively be positioned in other locations within or surrounding the enclosure, such as on the bottom panel, side panels, back panel, or any other support structure that allows the light to shine upon the lenticular screen.

The fireplace 100 is of a type that is typically inserted into existing masonry fireplaces. It should be understood that the lenticular screen 112 can be used in any construction of simulated fireplaces. The thin depth of the lenticular screen 112, approximately ¼ of an inch or less, allows construction of a fireplace that can be installed within a very limited space, yet fives the visual illusion of significant depth.

Figure 13:
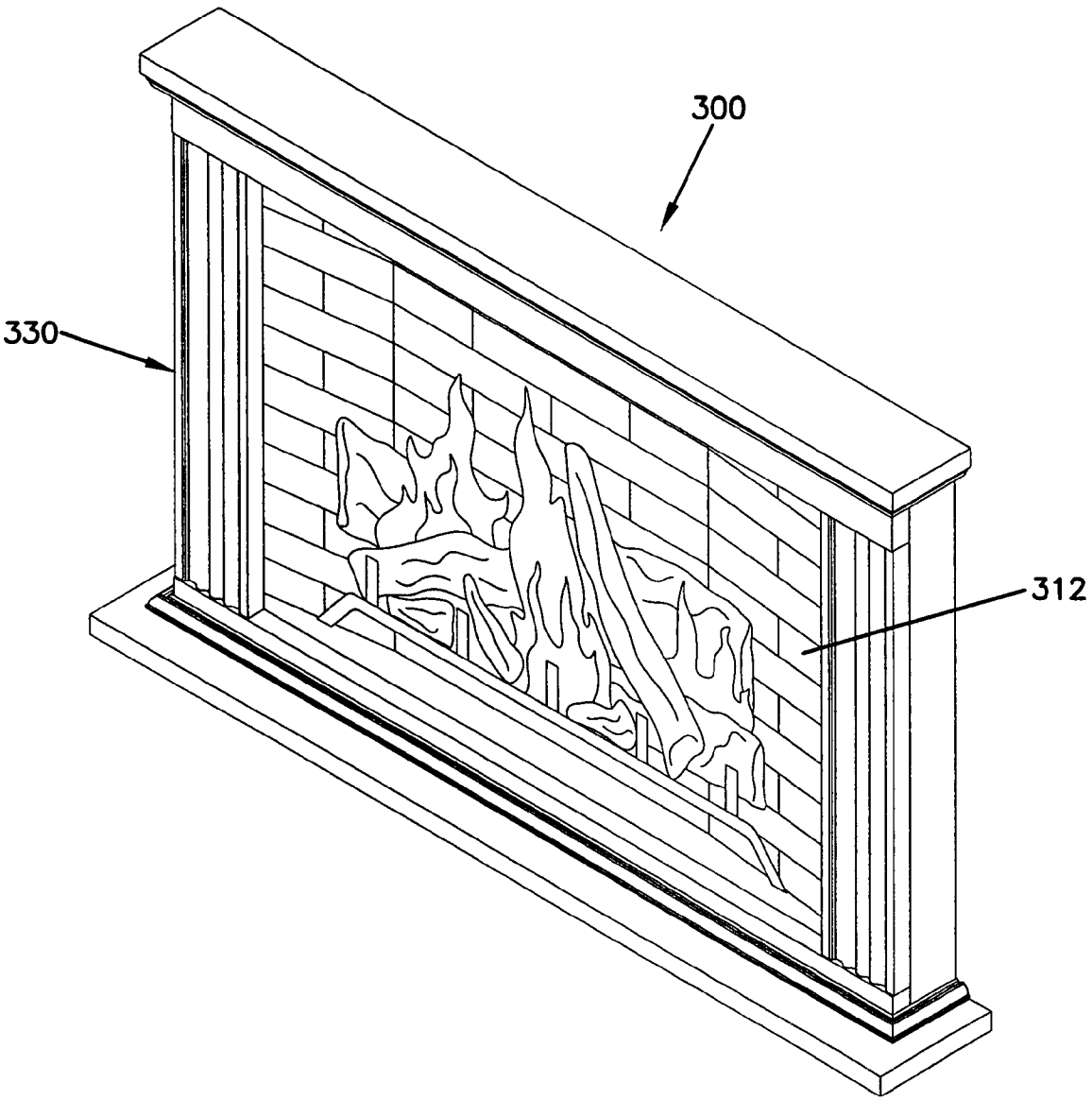
FIG. 13 is a schematic perspective view of a second embodiment of a lenticular fireplace.
Figure 14:
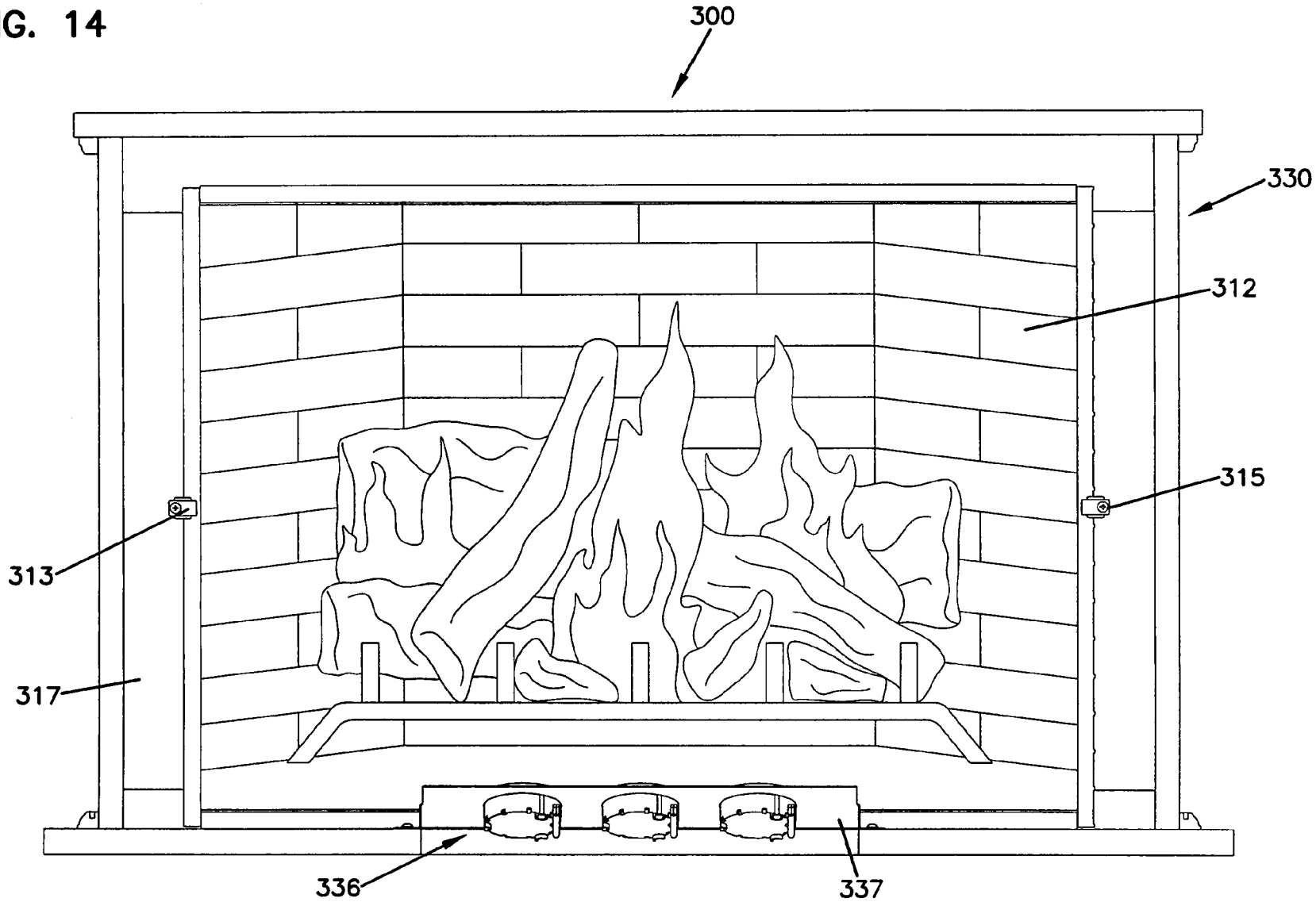
FIG. 14 is a schematic back view of the lenticular fireplace of FIG. 13.

FIG. 13 shows a front perspective view of a second embodiment of a lenticular fireplace 300. Fireplace 300 can be constructed for placement on walls or for insertion into recessed areas having depths of, for example, six inches or less. As shown in FIG. 14, the fireplace 300 can be constructed to include lenticular screen 312 and light source 336. Lenticular screen 312 is constructed as described for lenticular screen 112. Brackets 313 and 315 can be used to couple the lenticular screen to a framework 317.

The light source 336 can include one or more light bulbs to project light onto the lenticular screen and the bulbs can be positioned as desired. For example, as shown in FIG. 14, the light source 336 includes three light bulbs positioned on a light supporting bracket 337. An optional decorative assembly 330 can be attached to the framework 317 to simulate the exterior of a wood or gas fireplace.

In other lenticular fireplace embodiments, for example, the lenticular screen can be installed behind a fireplace front panel and into an area having a depth as small as one inch. Alternatively, an enclosure can be constructed having a similar one-inch depth in which the lenticular screen is disposed. A fireplace having a one-inch depth can be placed or hung at any position on a wall or recessed within the extremely limited space. Optionally, fireplaces of this type can include a device that changes the position of the lenticular screen to further enhance the simulation of the fire.

Device for Moving the Lenticular Lens

Figure 6:
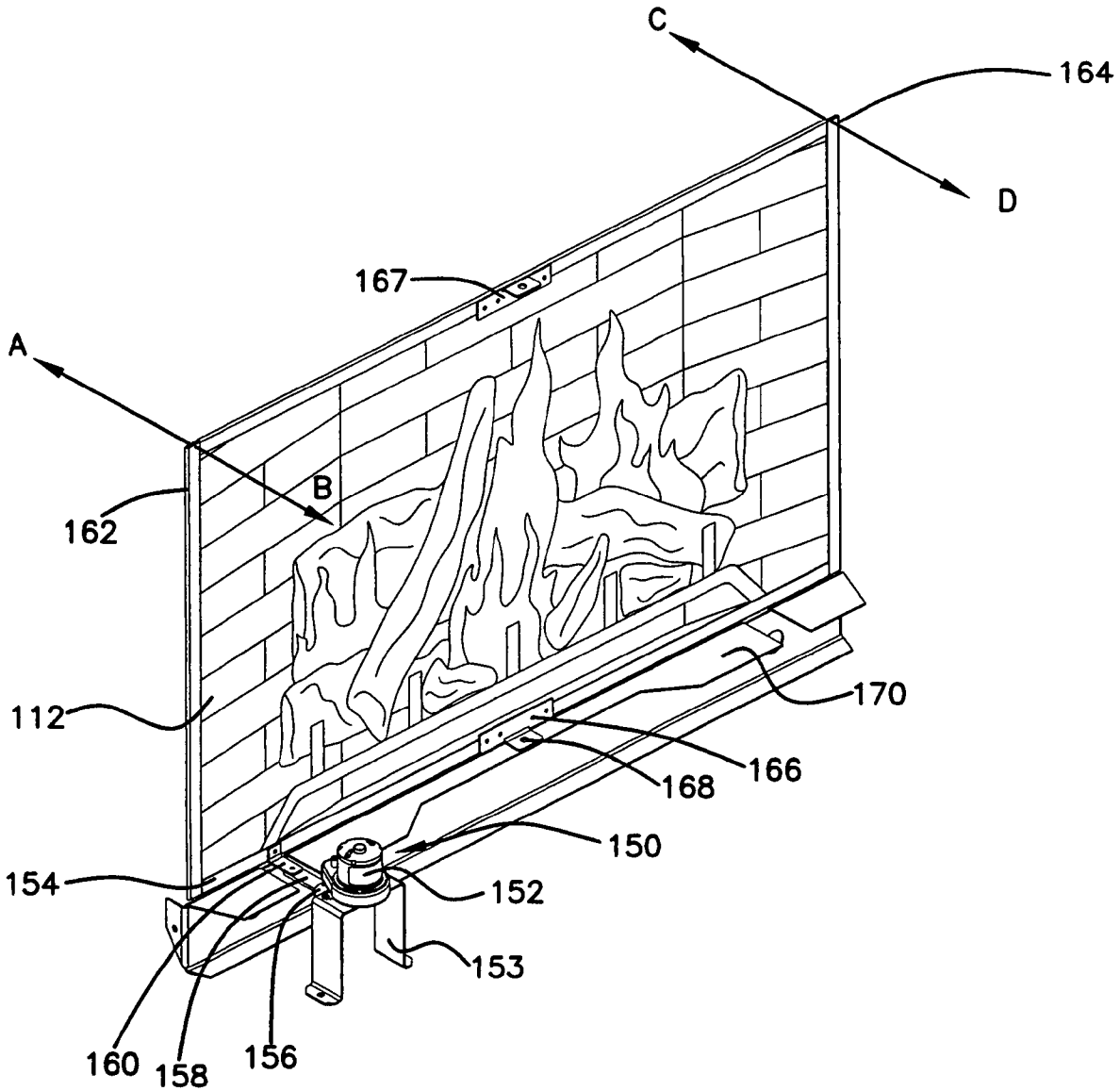
FIG. 6 is a schematic perspective view of one embodiment of a lenticular screen coupled to a device to move the lenticular screen.

In some embodiments, a device 150 can be coupled to a lenticular screen, such as, for example, lenticular screen 112 shown in FIGS. 1 and 6, to alter the position of the lenticular screen 112 and change the image that is viewed.

Referring to FIG. 6, the device 150 is used to change the position of the lenticular screen 112 during the operation of the fireplace 100. Changing the position of the lenticular screen 112 alters the fire image for a viewer and simulates a flame or burning effect, even though the viewer remains stationary relative to the screen. For example, the device 150 moves the lenticular screen 112 in the directions indicated by the arrows A-D on FIGS. 6 and 7. Any device that couples to and changes the position of the lenticular screen 112 can be used to enhance the flame effect.

The device 150 can include a bottom pivot bracket 166 to stabilize the movement of the lenticular screen 112. The bottom pivot bracket 166 defines a hole 168 and is connected to a lenticular screen support 170 raised above the bottom panel 118 of the enclosure 110. Alternatively, the bottom pivot bracket can be connected to any other construction that supports the lenticular screen, such as a bottom panel of a fireplace enclosure or a floor of structure, house, or building. The bottom pivot bracket 166 can be coupled to the lenticular screen support 170 with, for example, a pin or other connective device to provide a pivot action when the electric drive motor 152 drives the change in position of the lenticular screen 112, as herein described in more detail.

A top pivot bracket 167 can also be included. The top pivot bracket 167 is constructed similarly to the bottom pivot bracket 166 and is connected to the top panel 124 of the enclosure 110. Conventional bearings can be used within the holes of the top and bottom pivot brackets as well as at the disk/drive motor flange and drive motor flange/lenticular screen flange connections to improve motion of the lenticular screen and reduce wear on the components.

In one embodiment, the device 150 includes an electric drive motor 152 coupled to the lenticular screen 112 through a lenticular screen bracket 154. The lenticular screen bracket 154 encloses at least a portion of the outer edge of the lenticular screen 112. The bracket 154 can be constructed of a single part or multiple parts. The electric drive motor 152 is fixedly mounted on a drive motor support 153. The output shaft of the electric drive motor 152 couples to the lenticular screen bracket 154 through a reciprocating assembly that includes a rotatable disk 156, a drive motor flange 158 pivotably connected at one end to the disk 156 and at its other end to a lenticular screen flange 160 connected to the lenticular screen 112.

The electric drive motor 152 rotates the disk 156, which reciprocally drives the drive motor flange 158. As the drive motor flange 158 reciprocates, the lenticular screen 112, through movement of the lenticular screen flange 160, moves in the directions indicated by the arrows A-D on FIGS. 6 and 7. For example, as the flange 158 moves toward the front panel 114, a first outer edge 162 of the lenticular screen 112 is moved in the same direction toward the front panel 114, indicated by arrow A; simultaneously a second outer edge 164 of the lenticular screen 112 moves in a direction toward the rear panel 116, indicated by arrow D as a result of the pivotal mounting of screen 112 about the mounting bracket 166. When the flange 158 moves back, the first outer edge 162 reaches its closest position to the front panel 114, the first outer edge 162 moves in the direction of the rear panel 116, indicated by arrow B, and the second outer edge 164 moves in the direction of the front panel 114, indicated by arrow C. During one rotation of disk 156, the lenticular screen 112 will have moved in the directions indicated by arrows A and D and the directions indicated by arrows B and C. As the lenticular screen 112 pivots and changes its position relative to the observer, the viewable image changes to create, for example, a flickering flame effect. The flames grow, shrink, and shimmer as in a natural fireplace.

Alternatively, the fireplace can be coupled to a device that provides motion of the lenticular screen in the directions of the side panels of the enclosure. In another construction, force can be applied to the lenticular screen to bend the screen and alter the image. For example, the edges of the lenticular screen can be held in a stationary position and the position of the center of the screen can be altered. Alternatively, the center of the screen can be held in a stationary position and the edges of the lenticular screen can be altered. The mechanics of how the lenticular screen is moved are not as important as is the fact that appropriate means are provided to move the lenticular screen relative to a viewer so as to alter the image.

Flame Simulation Apparatus

Figure 7:
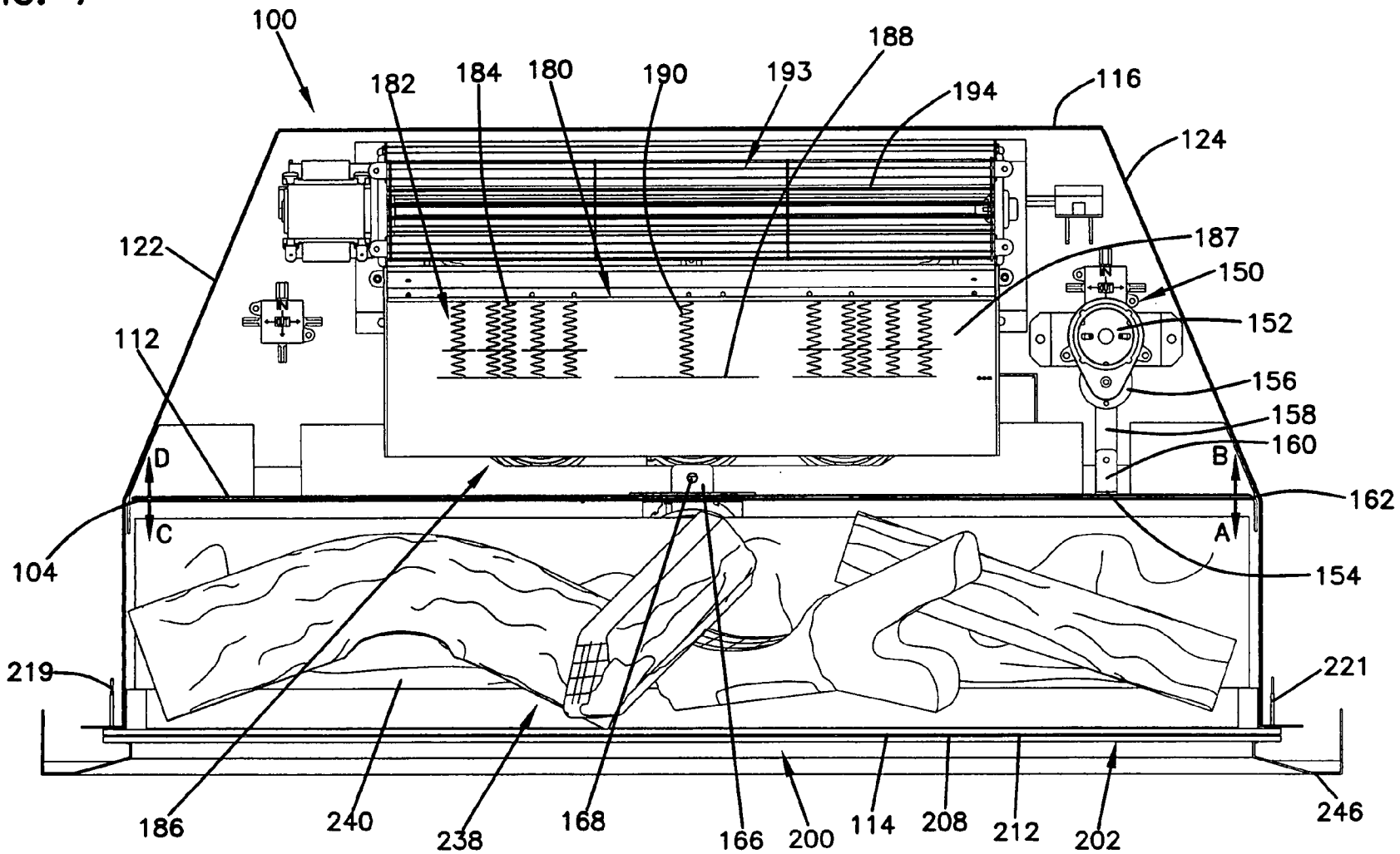
FIG. 7 is a schematic top cross-sectional view of the lenticular fireplace along line B-B of FIG. 1.
Figure 8:
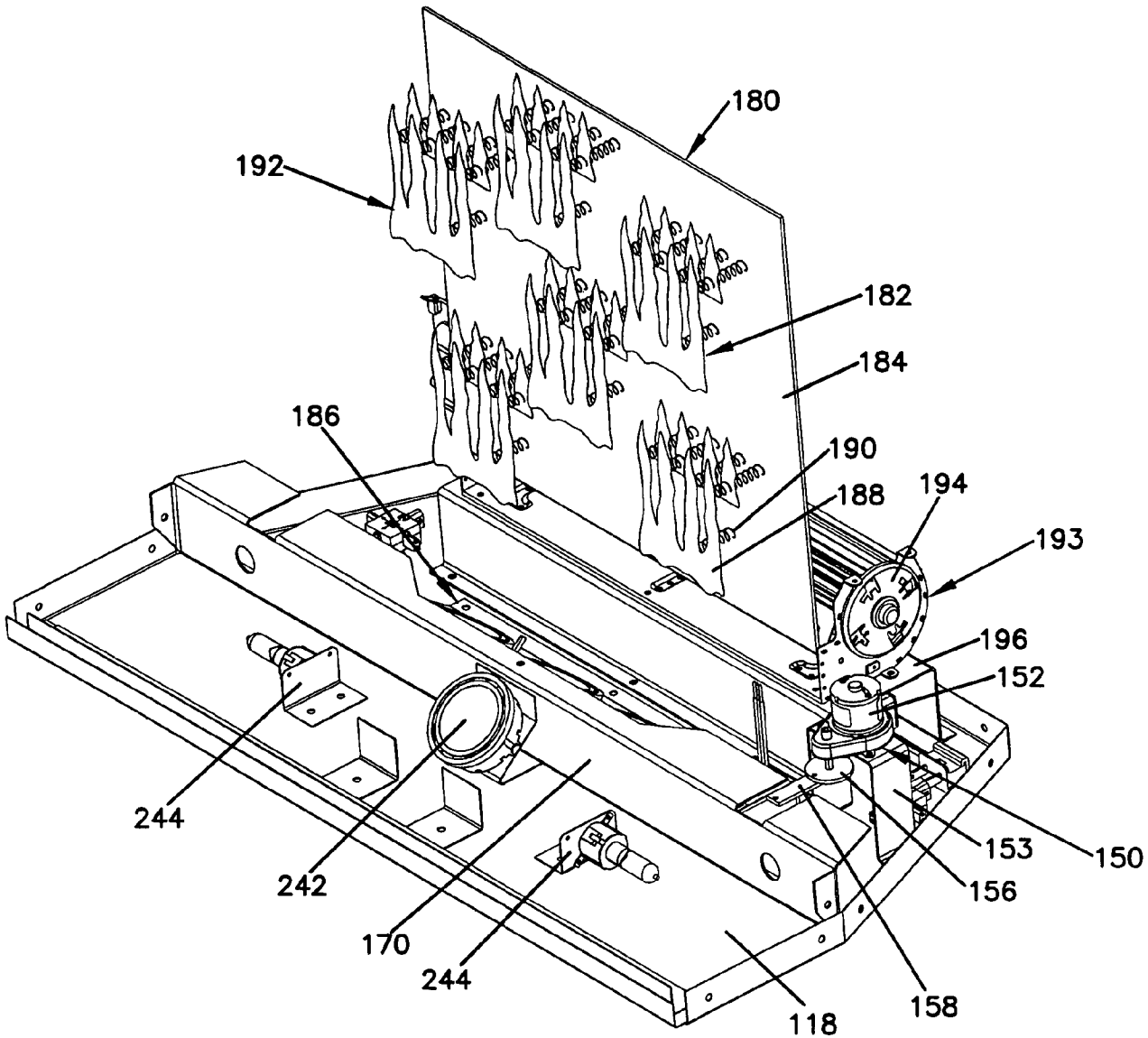
FIG. 8 is a schematic perspective view of the flame simulation apparatus.

Referring to FIGS. 3, 7 and 8, a flame simulation apparatus 180 is shown. The flame simulation apparatus 180 can include at least one bobble-flame 182, a support panel 184, a light source 186, and a translucent screen 112. An individual bobble-flame 182 includes a reflective material 188 and one or more springs 190 coupling the reflective material 188 to the support panel 184. The reflective material 188 can be any material that reflects light, such as Mylar, kapton, reflective fabrics, any other reflective material, or combinations of reflective materials. Any suitable spring can be used for bobble-flame 182 such as, for example, a helical spring. The support panel 184 can be a separate panel as shown in FIG. 3, or a different structure, such as the rear panel of an enclosure or a wall of a building.

The light source 186 is directed at a bobble-flame 182 to reflect light off of the reflective material 188 to simulate natural flames. The light source 186 can include, for example, one or more light bulbs to project the light onto the reflective material 188 and the bulb or bulbs can be positioned as desired. For example, as shown in FIG. 7 or 8, the light source 186 includes three light bulbs positioned on the bottom panel 118 of the enclosure 110. Light generated by the light bulbs can optionally pass through a translucent sheet 187 of colored material and onto the bobble-flame 182. Alternatively, the light source can be located in another location relative to the bobble-flame. For example, light 140 can provide the light that is reflected off of the bobble-flame 182.

Reflected light from the bobble-flame 182 is projected onto a translucent screen, such as lenticular screen 112, and a simulated flickering flame effect is viewable on the front surface 128 of the lenticular screen 112. Any suitable translucent screen can be used to simulate the flame effect. FIG. 3 also shows an example of a plurality of bobble-flames 192 used to generate the simulated flames on the lenticular screen 112. Alternatively, configurations of bobble-flames other than that shown in FIG. 3 are possible such that the simulation of a moving flame is viewable on any translucent screen.

A device 193 can be used to move the bobble-flames 192 to provide a flickering effect that improves the simulation of natural flames. For example, a blower 194 can be positioned to blow air onto the bobble-flames 192 (FIGS. 3, 7 and 8) to generate movement and the appearance of a natural flame. The blower 194 is positioned on a blower support 196 and directs airflow below the support panel 184, off of the back surface 130 of the lenticular screen 112, and onto the bobble-flames 192. Alternatively, the blower or other air-moving device can be positioned to pass air from the surroundings of and through an opening that is defined by the fireplace enclosure. In another configuration, a device, such as device 150, can be coupled to the support panel to move the panel and attached bobble-flames to simulate the flickering flame effect.

Convertible Heated Glass Apparatus

Figures 9, 10, 11, 12:
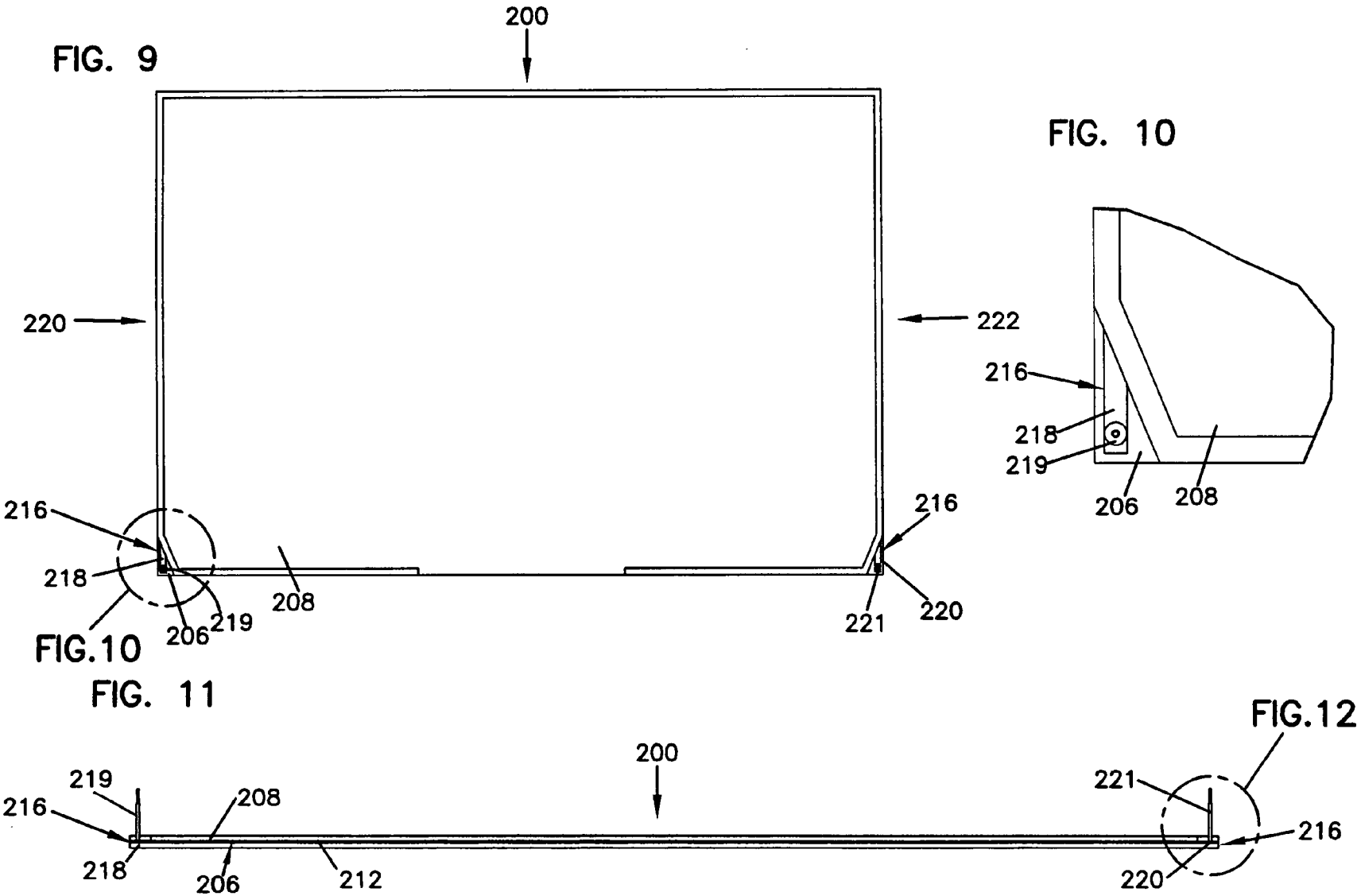
FIG. 9 is a schematic back view of one embodiment of a convertible heated glass apparatus for a fireplace.
FIG. 10 is a schematic detailed view of a portion of the convertible heated glass apparatus of FIG. 9.
FIG. 11 is a schematic bottom view of the convertible glass apparatus of FIG. 9.
FIG. 12 is a schematic detailed view of a portion of the convertible glass apparatus of FIG. 11.
Figure 12:
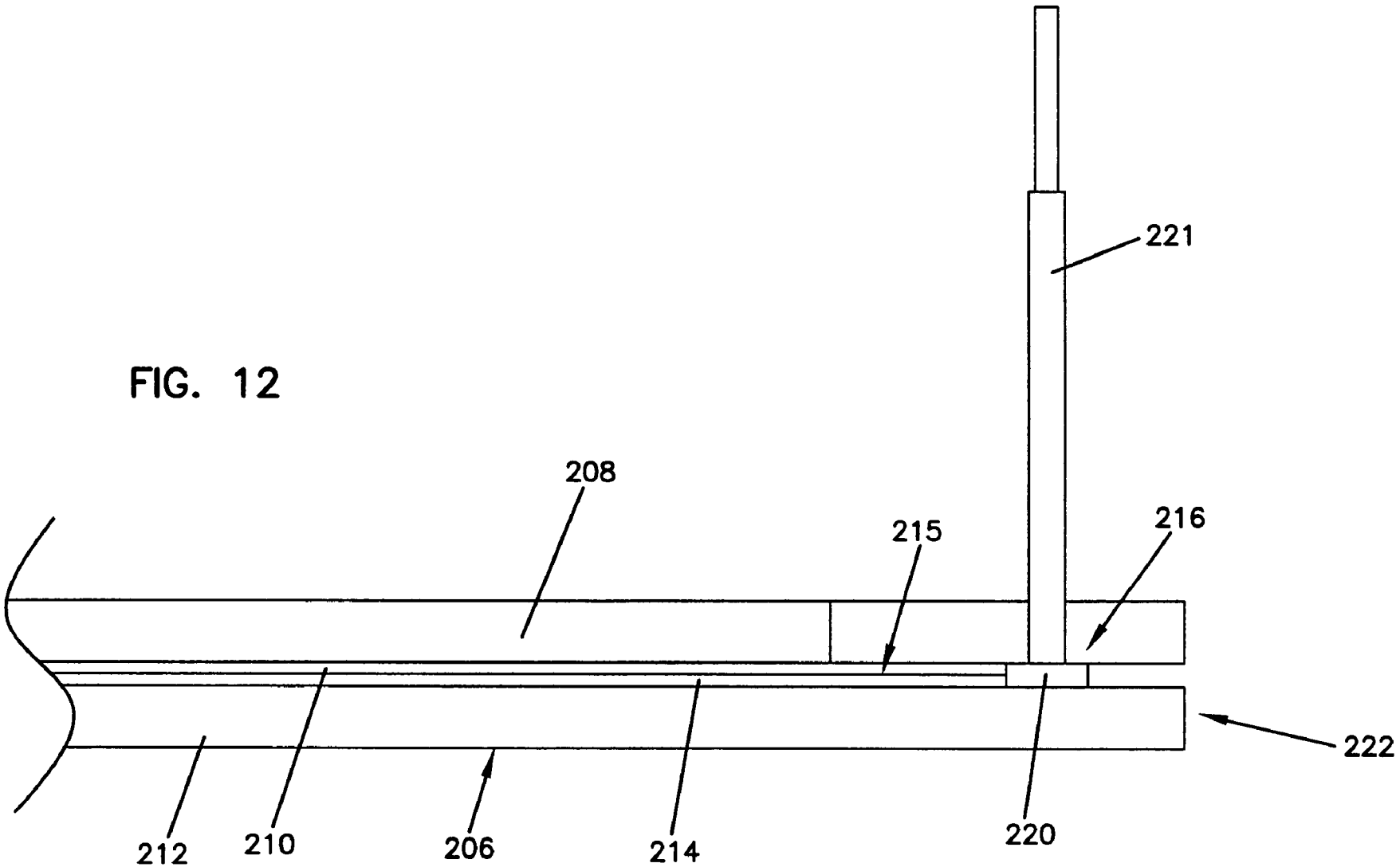

Referring to FIGS. 9 and 11, schematic back and bottom views of a convertible heated glass apparatus 200 are shown. The heated glass apparatus 200 can be used, for example, as a front wall 202 of lenticular fireplace 100. Alternatively, the heated glass apparatus 200 can be used on any fireplace construction.

The apparatus 200 can include a phase change material 210 that converts between an opaque solid to a less opaque liquid. When the phase change material 210 is an opaque solid, an observer cannot view through the glass and into a fireplace enclosure. The apparatus 200 can be included as part of a fireplace enclosure as a front wall that is coupled to side panels, a back panel, a top panel, and a bottom panel. For example, the apparatus 200 can be included as the front wall 202 of the fireplace enclosure 110 for lenticular fireplace 100, as shown in FIGS. 1-3. In other embodiments, the enclosure can include none, some, or all of these panels coupled to the front wall to form the enclosure. An example of an enclosure that does not couple the front wall to any panels includes using the front wall to cover a hole, in which the lenticular screen is disposed, that is cut into a wall of a structure.

Referring to FIGS. 11 and 12, the apparatus 200 includes an electrically conductive panel 206, a second panel 208, and the phase change material 210 disposed between the electrically conductive panel 206 and the second panel 208. Alternatively, the apparatus can be constructed without the second panel having the phase change material disposed within a space defined by the electrically conductive panel.

The electrically conductive panel 206 includes a glass layer 212 and an electrically conductive layer 214. Typically, the glass layer 212 and the second panel 208 are tempered glass. Alternatively, the glass layer and the second panel can be any glass able to withstand heating, such as ceramic glass. Examples of electrically conductive layers include, but are not limited to, fine wire heaters, substrate supported ultra thin metal films, tin doped indium oxide, fluorine doped tin oxide, or other conductive oxide layers. The electrically conductive layer 214 can optionally be provided to form at least a portion of the front surface or back surface of the electrically conductive panel 206. Typically, the electrically conductive layer forms at least a portion of the back surface of the electrically conductive panel, as shown in FIG. 12.

The electrically conductive panel 206 is connected to a pair of spaced terminals 218 and 220 suitable for connection to a voltage source, not shown, for passing current across the electrically conductive layer 214, which heats the apparatus 200 to a desired temperature. The spaced terminals 218 and 220 can be connected to the voltage source through, for example, insulated electrical wires 219 and 221. Any suitable voltage source can be used.

Referring to FIG. 10, a schematic detailed view of a corner portion of the convertible heated glass apparatus 200 is shown. In one embodiment, the voltage source is connected to a pair of bus bars 218 and 220. The bus bars 218 and 220 are located at opposed first and second edges 222 and 224 of the heated glass apparatus 200. The bus bars 218 and 220 are connected in circuit with the electrically conductive layer 214. As a voltage potential is applied between the bus bars 218 and 220 current flows across the layer 214 between the bus bars 218 and 220. The conductive layer acts as a resistor that generates heat as energy is dissipated by current flow therethrough, thereby heating the apparatus 200. The bus bars 218 and 220 can be composed of silver or other conductive materials, such as copper, that effectively conduct electricity to the electrically conductive layer 214, for generating heat across the apparatus 200.

Heat, generated from the electronically conductive panel 206 alters the state of the phase change material 210. The phase change material 210 is a thermally reversible light scattering film disposed between the electrically conductive panel 206 and the second panel 208. In the preferred embodiment, the phase change material 210 includes a first polymeric material that transforms from a solid to a liquid upon heating from the electrically conductive panel 206, from a temperature below its melting point to a temperature above its melting point. At temperatures below the melting point of the first polymeric material, the apparatus 200 has an opaque or frosted appearance. At temperatures above the melting point of the first polymeric material, the apparatus 200 becomes less opaque and items disposed within the fireplace enclosure are viewable through the apparatus 200. The convertible heated glass apparatus 200 is preferably of a type that can be heated to temperatures sufficient to transform the first polymeric material to a clear liquid. For example, FIG. 1 shows the apparatus 200 when heated sufficiently to appear clear such that the lenticular screen 112 is viewable therethrough.

The first polymeric material is dispersed within a second polymeric material that remains solid at temperatures greater than the melting point of the first polymeric material. The second polymeric material supplies a matrix that sustains an even dispersion of the first polymeric material during phase changes. The temperature at which the apparatus 200 changes from opaque to clear can be varied by adjusting composition of the phase change material.

The temperature of the glass can be controlled and adjusted to a desired temperature. The temperature can be adjusted to a temperature that causes the phase change material to turn from solid to liquid and produce a less opaque or clear front wall. Alternatively the temperature can be adjusted to a temperature below the melting point of the phase change material to provide warmth to a room without viewing items disposed behind the front wall and within the enclosure, or be raised to temperatures even greater than the melting point of the phase change material to provide additional heat to the room. The temperature of the electrically conductive panel can also be adjusted to intermittently heat the front wall at a temperature that provides a comfortable radiant heat to the room while keeping the first polymeric material at a temperature above its melting point.

A heated glass apparatus like the one described above can be obtained from Pleotint, L. L. C., located in West Olive, Mich. Pleotint manufactures its thermoscattering glass under the name ThermoSee™. Pleotint's ThermoSee™ glass has an operating range up to 185 degrees Fahrenheit.

Additional Fireplace Components

Several optional components can be used in the fireplace construction shown in FIGS. 1-3. For example, a decorative assembly 230 can be used to cover a control panel 232. The control panel 232 can include switches 234 and rheostats 236 that regulate lighting, speed of the drive motor 152, speed of the blower 194, and the temperature of convertible heated glass apparatus 200. Also, a log set 238 and electric ember bed 240 can be used to enhance the aesthetic appeal of the fireplace. The electric ember bed 240 can include light sources 242 and 244, such as halogen lights, for illumination. Optionally, colored filters can be used between the light source or sources and the ember bed to create a more natural looking ember bed glow. A decorative frame 246 that covers the outer edge of the front panel 114 of the fireplace 100 can be optionally used. Also, a fireplace grate (not shown) can be placed in the enclosure 110 or a mesh screen (not shown) can be coupled to the decorative assembly 230 in front of the lenticular screen 112.

The present invention should not be considered limited to the particular examples or materials described above, but rather should be understood to cover all aspects of the invention as fairly set out in the attached claims. Various modifications, equivalent processes, as well as numerous structures to which the present invention may be applicable will be readily apparent to those of skill in the art to which the present invention is directed upon review of the instant specification.

What is claimed is:

1. A heating appliance, comprising:

an enclosure defining a chamber, the enclosure having an open front; and a lenticular screen including a lenticular lens layer having a plurality of lenticule formed on one surface of the lenticular lens layer and an image layer disposed on an opposing surface of the lenticular lens layer, the image layer including an image of a fire;

wherein the lenticular screen is positioned at least partially within the enclosure and the image layer is viewable through the open front.

2. The heating appliance of claim 1, wherein the image of the fire comprises logs, flames, and walls of a firebox.

3. The heating appliance of claim 1, further comprising a device coupled to the lenticular screen that alters the position of the lenticular screen to change a viewed image of the fire.

4. The heating appliance of claim 1, further comprising a heat source.

5. A method of simulating a fire within a simulated fire apparatus, the method comprising the steps of:

providing an enclosure defining a chamber, the enclosure having an open front;

providing a lenticular screen having a lenticular lens layer including a plurality of lenticule formed on one surface of the lenticular lens layer and an image layer disposed on an opposing surface of the lenticular lens layer, the image layer comprising an image of a fire; and positioning the lenticular screen at least partially within the enclosure such that the image layer is viewable through the open front of the enclosure.

6. The method of claim 5, further comprising viewing of different portions of the image layer when viewing the image layer through the lenticular lens layer at different viewing angles.

7. The method of claim 5, further comprising directing light onto the lenticular screen from a light source.

8. The method of claim 5, further comprising providing artificial flame members within the enclosure adjacent to the lenticular screen to further simulate a fire.

9. The method of claim 5, further comprising providing an artificial log between the lenticular screen and the open front of the enclosure.

10. The method of claim 5, further comprising:

providing a heat source with the simulated fire apparatus; and generating heat from the heat source when the image layer is viewable.

11. A simulated fire apparatus, comprising:

a lenticular screen having a lenticular lens layer and an image layer disposed on a rear surface of the lenticular lens layer, the image layer comprising an image of a fire;

a front panel defining an opening through which the lenticular screen is viewable;

an artificial log positioned adjacent to the lenticular screen; and a heat source configured to generate heat.

12. The apparatus of claim 11, further comprising an enclosure defining a chamber, wherein the lenticular screen is disposed in the chamber.

13. The apparatus of claim 12, further comprising an artificial flame member positioned in the chamber.

14. The apparatus of claim 12, further comprising a light source positioned in the chamber.

15. The apparatus of claim 11, wherein the lenticular lens layer includes a plurality of lenticule lenses that define a two-dimensional ribbed planar configuration.

16. The apparatus of claim 11, wherein the fire image includes a combination of images.

17. The apparatus of claim 11, wherein the lenticular screen is semi-transparent or translucent.

* * * * *